United States Patent [19]

Paurus et al.

[11] 4,383,474

[45] May 17, 1983

[54] MUZZLE POSITION SENSOR

[75] Inventors: Donald L. Paurus, Delano; Evert E. Lehtola, Mound, both of Minn.

[73] Assignee: The United States of America as represented by the Secretary of the Army, Washington, D.C.

[21] Appl. No.: 148,426

[22] Filed: May 9, 1980

[51] Int. Cl.[3] ..... F41G 3/00

[52] U.S. Cl. ..... 89/41 ME; 356/141

[58] Field of Search ..... 89/14 R, 41 ME; 356/141, 152

[56] References Cited

U.S. PATENT DOCUMENTS 3,744,913 7/1973 Farthing et al. ..... 356/141

4,020,739 5/1977 Piotrowski et al. ..... 89/41 ME

FOREIGN PATENT DOCUMENTS 2909629 9/1980 Fed. Rep. of Germany ... 89/41 ME

OTHER PUBLICATIONS

L. D. Hutcheson, "Practical Electro-Optic Deflection Measurements System", Optical Engineering, vol. 15, No. 1, pp. 61–63, 1976.

B. O. Kelly, "Lateral-Effect Photodiodes", Laser Focus, Vol. 12, No. 3, pp. 38–40, Mar. 1976.

Merrill I. Skolnik, Radar Handbook, 1970, pp. 21–25 to 21–27.

*Primary Examiner*—Stephen C. Bentley

*Attorney, Agent, or Firm*—Peter A. Taucher; John E. McRae; Nathan Edelberg

[57] ABSTRACT

Gun muzzle deflection detector means comprising a depletion mode linear photodiode sensor having four electric outputs representing elevational and azimuth displacement of an optical signal impinging on the sensor face, said sensor outputs being combined and amplified to provide error signals representative of the muzzle deflection from a true zero deflection condition in the elevation and azimuth directions. An automatic gain control is used to adjust the error signals up or down inversely according to the absolute values of the light impinging on the sensor, thereby compensating for possible errors due to fog or airborne particulates in the optical system.

1 Claim, 5 Drawing Figures

MUZZLE POSITION SENSOR

The invention described herein may be manufactured, used, and licensed by or for the Government for governmental purposes without payment to me of any royalty thereon.

BACKGROUND AND SUMMARY OF THE INVENTION

This invention is directed to improvements in gun muzzle deflection detector means of the general type shown in U.S. Pat. No. 3,684,383 to Johansson and U.S. Pat. No. 4,142,799 to Barton. Each of these patents discloses an optical system wherein a light beam is directed forwardly along the barrel of a main gun on a military vehicle to impinge on a mirror located on the muzzle end of the gun. The light beam is reflected rearwardly to an optical sensor located at or near the breech end of the gun; in the case of a trunion-mounted gun the sensor is located as close as possible to the trunion axis to maintain an invariant optical system as the gun elevational angle changes during firing operations. The optical system detects deflection of the gun muzzle in the elevation and/or azimuth directions due to such factors as gravity, thermal bending caused by sun striking the barrel upper surface, uneven barrel cooling due to rain or wind, uneven heating due to firing, cross winds, etc.

The present invention contributes to this general system an optical detector comprised of a depletion mode linear photodiode sensor having four output terminals oriented, respectively directly above, directly below, directly to the right, and directly to the left of the detector optical axis representing zero gun muzzle deflection. The four outputs are combined and amplified to provide input corrective signals to a main gun ballistic computer.

THE DRAWINGS

FIG. 1 fragmentarily illustrates a side elevational view of a military tank gun system having a muzzle detector mechanism of the present invention installed thereon.

Figure 1:
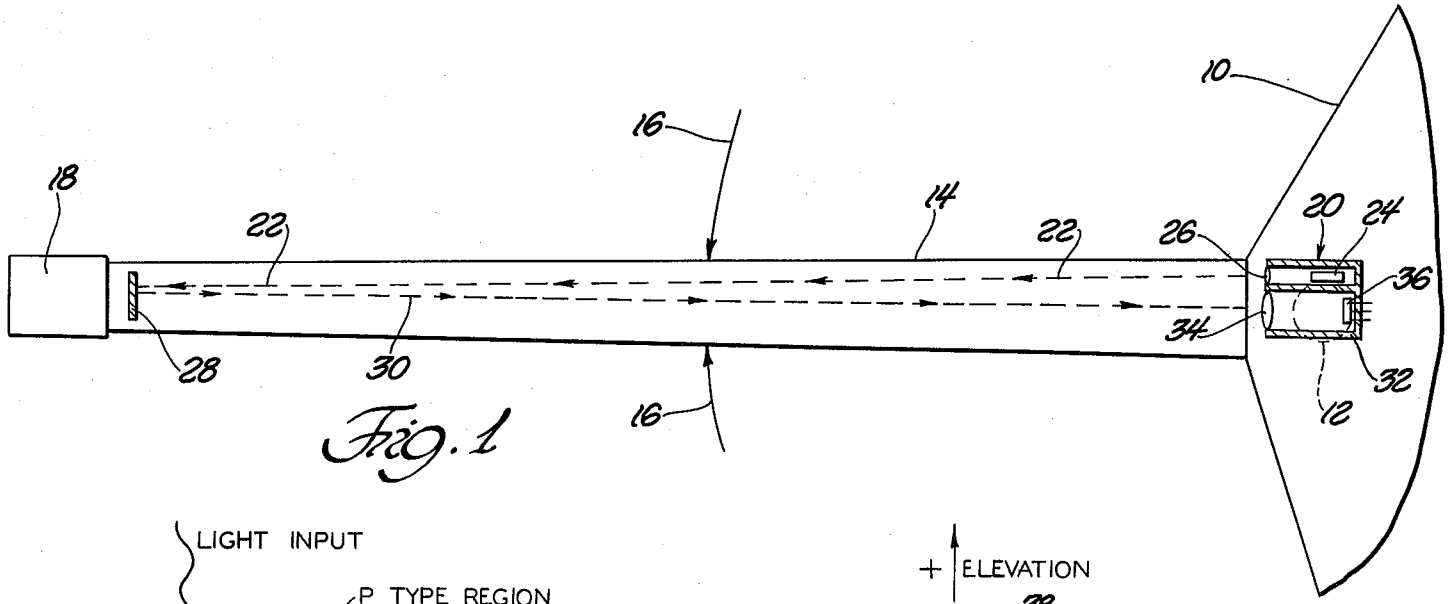

As previously noted, the present system is generally similar to the detector system shown in U.S. Pat. Nos. 3,684,383 and 4,142,799. The illustrated system comprises a military tank turret 10 that supports trunions 12 of main gun 14, said gun being adapted to move in the elevational plane as denoted by arrows 16. The present invention is directed to means for detecting undesired deflection of gun muzzle 18 due to such factors as sun, wind, gravity, rain, heat of fire, etc.

The detector system comprises a pulsed infrared light beam source 20 located near the breech end of the gun, preferably near the trunion axis 12, to direct an infrared beam of light along path line 22. Light source 20 can be a conventional Gallium Asenide laser diode 24 and transmitting lens 26 arranged to produce a relatively narrow beam 22 having a diameter of about three milimeters at a pulse repetition rate of about 160 pulses per second in the 904 nanometer wavelength region. Such a laser diode source is distinguishable from steady-state ambient light conditions common in the environment. The laser beam preferably has a very low power factor for reasons of human eye safety. The optical beam 22 is directed forwardly to a polished stainless steel mirror 28, then is reflected rearwardly along path-line 30 to a detector mechanism 32 mounted at the breech end of the gun.

Detector 32 comprises a focusing lens 34 for focusing or narrowing the beam onto a photodiode detector 36 located at the lens focal point. Detector 36 is preferably a discrete silicon, lateral-effect, linear photodiode having four electrical output terminals that produce signals varying in strength according to the terminal's relative nearness to the centroid of the focused light beam received on the detector front face. A preferred industrial source for detector 36 is United Detector Technology Inc., 2644 30th Street, Santa Monica, Calif., sensing detector specification PIN-SC/25 or PIN-SC/10.

Figure 2:
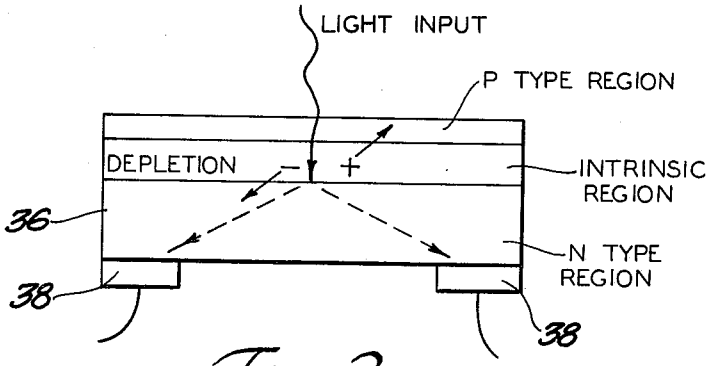
FIGS. 2 and 3 illustrate some features of a detector used in the FIG. 1 mechanism.
Figure 3:
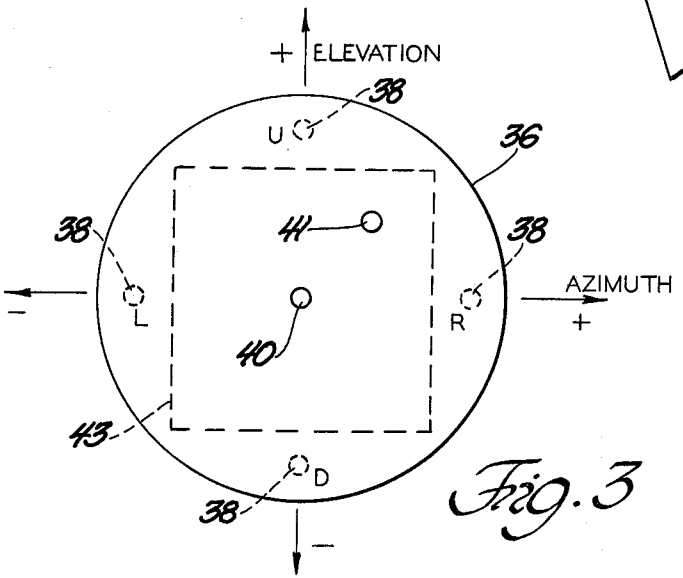

As seen in FIGS. 2 and 3 the detector 36 has on its rear face four output terminals 38 designated respectively by the letters U, D, R, and L, meaning up, down, right, or left when referenced to the fixed central terminal 40 located at the intersection of the elevation and azimuth axis. When the focused light beam impinges on detector 36 at its central axis equal currents are directed to each of the four terminals 38. When the focused light beam moves off the central axis a proportionately smaller current goes to the furthest terminal, and a proportionately larger current to the nearest terminal. As an example, a light beam impinging on the detector at point 41, FIG. 3, would produce relatively large output currents at terminals U and R, and relatively small output currents at terminals L and D. The imaginary square space circumscribed by line 43 in FIG. 3 represents the active area of the detector; in a representative structure the area measures about 0.7 inch on a side.

Figure 4:
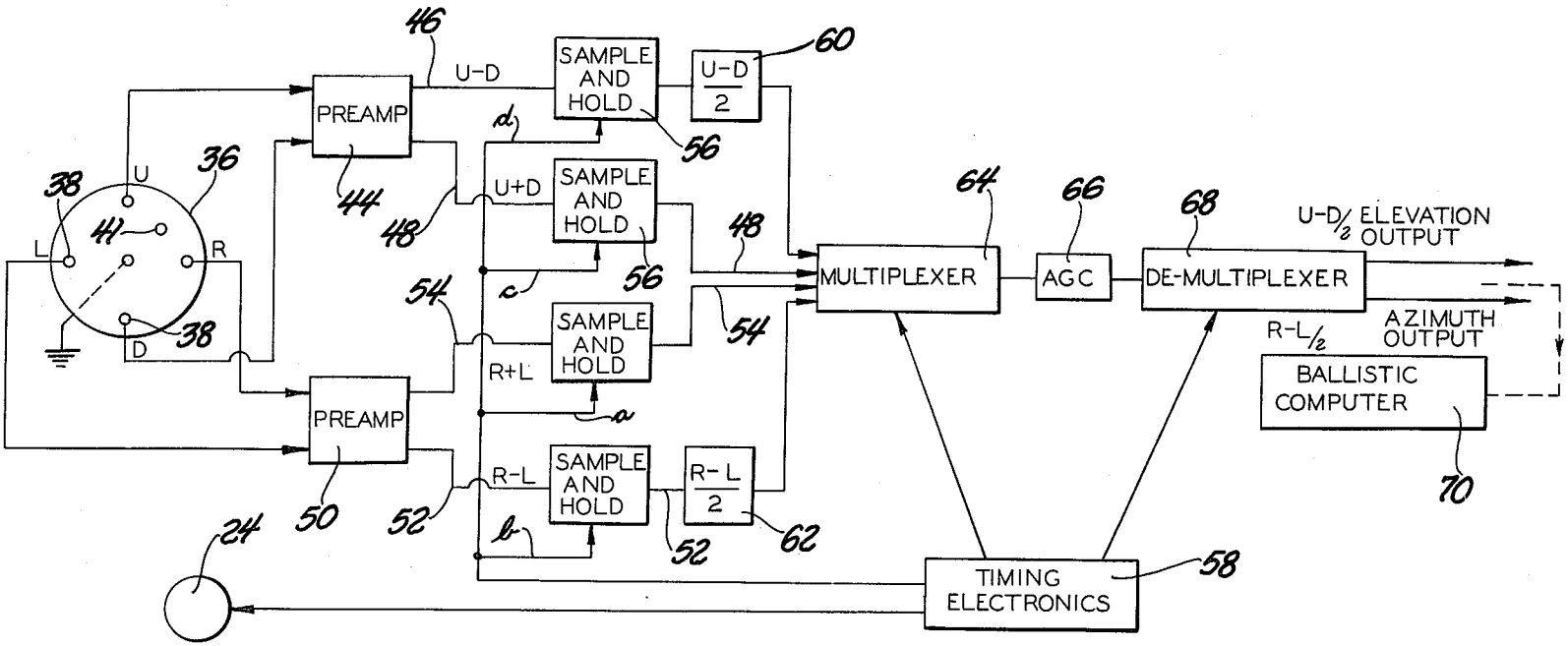
FIG. 4 is a block diagram of a circuit utilizing the detector of FIGS. 2 and 3.
Figure 5:
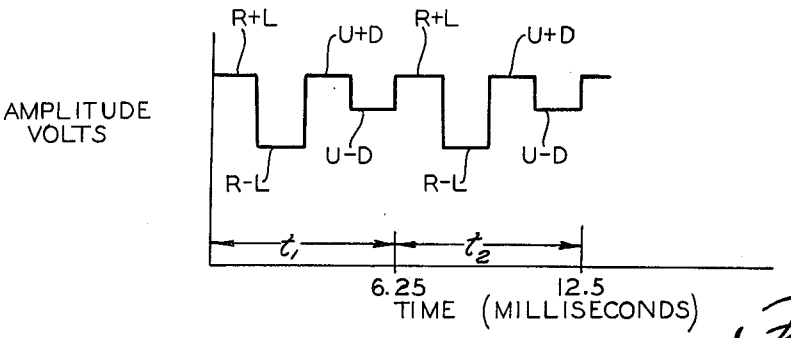
FIG. 5 illustrates voltage outputs from sample and hold units in the FIG. 4 circuit.

Referring to FIG. 4, the circuit thereshown includes a first amplifier 44 having differencing and summing amplifiers therein for providing first and second output signals 46 and 48 representing respectively the difference between the U and D output signals from detector 36, and the sum of the U and D output signals. A second amplifier 50 containing differencing and summing amplifiers therein produces third and fourth signals 52 and 54 representing, respectively the difference between the R and L outputs, and the sum of the R and L outputs. The individual amplified signals are applied to sample and hold units 56 that are triggered or conditioned by individual timing signals a, b, c, and d generated at the timing electronic unit 58. The timing is such as to produce time-staggered outputs from the sample and hold units, as indicated generally in FIG. 5. The time gradation t1, t2, necessary to provide each packet of four signals corresponds to the pulse frequency of the laser 24, in this case 160 pulses per second or 6.25 milliseconds per laser pulse.

The first and third signals 46 and 52 are averaged at 60 and 62 before being fed to a conventional time multiplexer 64 for simultaneous transmission to an automatic gain control 66, demultiplexer 68, and ballistic computer 70. The purpose in thus supplying the first and third signals 46 and 52 to the ballistic computer is to add corrections in addition to the corrections that the computer conventionally makes for such factors as range, ammunition grain temperature, cross wind, air temperature and density, etc.

Signals 46 and 52 represent, respectively, dislocation or offset of the impinging light beam 41, FIG. 3, from the central axis 40 of detector 36 in the elevational and azimuth directions. Assuming that axis 40 represents zero muzzle deflection from a true or straight gun barrel condition, signals 46 and 52 will represent muzzle deflection due to a myriad of factors that could affect the accuracy of the gun.

The absolute values for signals 46 and 52 are affected by fog, dust, sand or other optical interference existing along optical paths 22 and 30. To compensate for this effect the electronic system preferably includes an automatic gain control 66 that utilizes the average light levels represented by signals 48 and 54 to adjust the values of signals 46 and 52 up or down inversely according to the absolute light values denoted by signals 48 and 54.

The principal advantage of my system is due to the use of the discrete silicon, lateral-effect, linear photodiode 36 that provides four distinct electric output signals U, D, R, and L related to the position of the impinging beam 41 on the detector surface. This photodiode provides continuous beam position information with no dead regions or zones as occur with focal plane arrays or segmented photodiodes. The described photodiode 36 is not affected by changes in the size of the light beam 41. It is a relatively inexpensive component that is compatible with shock loads associatd with gun operations. It does not require special phase clocking or timing electronics.

I wish it to be understood that I do not desire to be limited to the exact details of construction shown and described for obvious modifications will occur to a person skilled in the art.

We claim:

1. In a military vehicle having a main gun, improved means for detecting gun muzzle deflection comprising a pulsed infrared light beam source on the gun near the breech end of the gun; a reflector mounted on the gun muzzle to receive the light beam and reflect same back toward the breech; a detector (36) mounted on the gun near the gun breech in the path of the reflected beam, whereby the detector senses changes in the direction of the beam caused by muzzle deflection; said detector comprising a depletion-mode linear photodiode sensor having four output terminals U, D, R and L oriented, respectively, directly above, directly below, directly to the right, and directly to the left of the detector optical axis representing zero muzzle deflection; first amplifier means (44) connected to the U and D terminals to develop a first light detector signal (46) representing the difference between the U and D outputs, and a second reference signal (48) representing the sum of the U and D outputs; second amplifier means (50) connected to the R and L terminals to develop a third light detector signal (52) representing the difference between the R and L outputs, and a fourth reference signal (54) representing the sum of the R and L outputs; means (60) and (62) for dividing the first and third detector signals in two; a sample and hold unit (56) receiving each of the two light detector signals and two reference signals to produce time-staggered signals; a multiplexer (64) receiving the time-staggered signals for simultaneous transmission thereof; an automatic gain control receiving the multiplexed signals for adjusting the two light detector signals up or down inversely according to the absolute values of the second and fourth reference signals; and circuit means for applying the adjusted first and third detector signals as corrections to a main gun ballistic computer.

* * * * *